106-33.7 SR
10/22/85 XR 4,548,256

United States Patent [19]
Glinn et al.

[11] Patent Number: 4,548,256
[45] Date of Patent: Oct. 22, 1985

[54] CASTING OF METAL ARTICLES

[75] Inventors: Terence G. J. Glinn, Stourmouth, Nr. Canterbury; Robert J. Deverill, Guildford, both of England

[73] Assignee: The Secretary of State for Defence in Her Britannic Majesty's Government of the United Kingdom of Great Britain and Northern Ireland, London, England

[21] Appl. No.: 546,387

[22] Filed: Oct. 28, 1983

[30] Foreign Application Priority Data

Nov. 3, 1982 [GB] United Kingdom ..... 8231405

[51] Int. Cl.[4] ..... B22C 1/00
[52] U.S. Cl. ..... 164/529; 106/38.9
[58] Field of Search ..... 164/34–36, 164/529, 369; 106/38.9

[56] References Cited

U.S. PATENT DOCUMENTS 3,770,469 11/1973 Kapolyi et al. ..... 106/120
4,020,027 4/1977 Nicholas et al. ..... 106/38.5

FOREIGN PATENT DOCUMENTS 1249461 9/1967 Fed. Rep. of Germany ..... 106/38.9

OTHER PUBLICATIONS

Chemical Abstracts, vol. 86, Mar. 21–Apr. 4, 1977, Bibka et al, "Study of . . . Dicalcium Silicate . . . ", p. 334.
Chemical Abstracts, vol. 90, Mar. 5–19 1979, Thomas et al, "The Beta to Gamma Dicalcium Silicate Phase Transformation," p. 173.

*Primary Examiner*—Nicholas P. Godici
*Assistant Examiner*—Richard K. Seidel
*Attorney, Agent, or Firm*—William R. Hinds

[57] ABSTRACT

A casting process is described, the process embodying the use of cores made from material comprising dicalcium silicate. Dicalcium silicate undergoes various phase changes during heating and cooling one of which, the $\beta$ to $\gamma$ transformation, is accompanied by a large volume increase. By using this feature casting cores may be produced which disintegrate during cooling of the solidified metal.

14 Claims, No Drawings

CASTING OF METAL ARTICLES

This invention relates to the casting of metal articles, particularly articles having internal passages and/or cavities.

It is well-known to use shaped cores in the production of castings having internal passages or other hollow portions, the molten metal being poured around a core which is removed after solidification of the casting. Cores may be conveniently produced in a granular material, such as sand which is compacted before use, or they may be moulded from ceramic materials which will withstand the heat of the casting process. Granular cores can often be readily removed by mechanical means as can some ceramic cores though recourse is frequently made to 'leaching' in which the core material is removed by the action of suitable chemical agent such as for example, sodium hydroxide solution.

In certain circumstances the removal of cores by mechanical means or by leaching is unsuitable or undesirable, for example where a core of complex shape is required and the chemicals employed are likely to have unwanted effects on the metal of the finished article.

The present invention provides a core which will disintegrate as the result of controlled heat treatment.

A casting process according to the invention includes the steps of producing a core comprising dicalcium silicate as its principal ingredient, forming a casting around the core and disintegrating the core during cooling of the casting.

The common phases of dicalcium silicate ($2CaO.SiO_2$) are:

$\alpha_m$—hexagonal, density 3.07 g/cc, stable above 1430° C.

$\alpha^1$—orthorhombic, density 3.31 g/cc, stable on heating through 900°-1447° C. and on cooling through 1447° to 675° C.

$\beta$—monoclinic, density 3.28 g/cc, a metastable phase between 675°-400° C., capable of being preserved at room temperature under certain conditions.

$\gamma$—orthohombic, density 2.97 g/cc. The room temperature stable phase formed by inversion of $\beta$ to $\gamma$ at 400° C. to a fine powder.

According to a feature of the invention, a core formed of dicalcium silicate may first be sintered in the temperature range in which the high temperature hexagonal phase is stable and then cooled rapidly so as to avoid the $\beta$ to $\gamma$ phase change. This initial heating of the core ensures that sintering takes place in the temperature range for which the high temperature hexagonal phase ($\alpha$ phase) is stable, ie above nominally 1430° C.

The sintering temperature will be chosen to be at least as high as the subsequent metal casting temperature so as to obviate any further significant sintering of the core and so promote dimensional stability. The rapid cooling is preferably effected by air quenching at room temperature. This avoids the $\beta$ to $\gamma$ phase change which, as indicated above, begins to occur at 400° C. and as shown in the density difference, is accompanied by a large volume change and consequent disintegration. The core resulting from the initial sintering operation and rapid cooling is stable and can be stored until required for use. The rapid cooling of sintered cores prevents the $\beta$ to $\gamma$ phase change because of insufficient thermal energy being available for the reaction which is of a nucleation and growth type rather than a crystalline shear type transformation.

Disintegration of the core after casting may then be effected by cooling the casting very slowly eg over several hours, so as to allow the core sufficient time to undergo the $\beta$ to $\gamma$ phase change.

Advantageously the calcium disilicate is not pure. Indeed, according to an important feature of the invention the dicalcium silicate may include a stabilizer for stabilizing the $\beta$ phase thereof and to facilitate sintering. Typical stabilizers include oxides of chromium, sodium oxide, molybdenum trioxide, and boric oxide.

The behaviour of material thus stabilized is markedly influenced by the thermal treatment, in particular dusting (disintegration) is enhanced the higher the holding temperture during sintering (provided fusion does not occur), the longer the time of holding, and the slower the cooling rate.

Stabilization is also advantageous in enabling storage of cores until required for use. According to another feature of the invention a destablizer may then be introduced to override the stabilizer and promote dusting. Iron and nickel in elemental or compound forms may be used as destabilizers. Thus after a batch of cores has been produced and stored, one selected for use may be heated in contact with pellets of iron, ferric nitrate, iron oxide, nickel, nickel oxide, or by heat soaking in a ferrous solution. The particular advantage to the use of a destabilizer is that slow cooling of the casting, which may not be desirable from the point of view of the structure of the casting, may not be required.

It has been found that destabilisation and consequent dusting on cooling is most effectively initiated by surface contact with certain metals. Most noteably, nickel, iron and cobalt are effective in promoting destabilisation. This fact is most useful in the production of gas turbine engine components since the majority of such components are cast from alloys based on nickel, cobalt or iron.

The 'dusting' associated with the $\beta$ to $\gamma$ transformation of dicalcium silicate is well-known, and has been utilised as a means of producing self-disintegrating portland cement clinker (Kapolyi et al U.S. Pat. No. 3,770,469) but this material is not known to have been previously employed for the manufacture of cores as part of casting processes. In general however this is an undesirable phenomenon since it can lead to unwanted effects eg bricks are liable to fall apart if dicalcium silicate is present in them.

Cores produced in accordance with the invention are particularly suitable for advanced casting processes such as are for instance used in the production of gas turbine blades. They can be easily fabricated to quite complex shapes, have adequate strength to permit all necessary manipulation together with minimum dimensional change and a capability of withstanding casting temperatures with negligible core/metal interaction. They have adequate thermal shock and impact resistance and are readily removable after solidification and cooling of the blade due to the dusting phenomenon.

In one example of a casting process according to the invention a gas turbine blade core is moulded from dicalcium silicate powder ($2\ CaO.SiO_2$) having 0.5% chromium oxide ($Cr_2O_3$) powder mixed therein and sintered at a temperature of 1500° C. for several hours followed by rapid air quenching to room temperature. The core is next assembled in a casting mould which was heated to 1500° C. and a nickel based superalloy at a temperature of 1500° C. introduced. The mould with casting and core is allowed to cool to a temperature just below 1430° C. in a manner inducing unidirectional solidification of the blade. This was followed by slow cooling in the casting furnace to room temperature during which time the furnace controls are manipulated to slow the normal rate of cooling. On completion of the cooling process, the core will have disintegrated to a fine powder which can readily be removed from the casting. A washing operation such as, for example, flushing out the internal passages with high pressure water to assist in removing the dust and those particles adhering to the channel walls may prove advantageous.

In another example a core is moulded from dicalcium silicate containing 0.2 weight percent chromium oxide and sintered for 2 hours at 1450° C. followed by air quenching. The remainder of the casting process is as described in the first example above.

We claim:

1. A process for making metal castings comprising the following steps:

(i) shaping a mold core from material comprising dicalcium silicate as its principal ingredient, (ii) sintering said shaped core in the temperature range in which the high temperature hexagonal phase of the dicalcium silicate is stable and (iii) cooling said sintered shaped core at a rate such as to avoid the $\beta$ to $\gamma$ phase change; and thereafter (iv) placing said cooled sintered shaped core within a mold, (v) pouring molten metal into the cored mold, (vi) controlling the cooling of the poured metal so as to cause self disintegration of the mold core during cooling upon reversion of the dicalcium silicate to its ambient temperature phase, and (vii) separating the metal casting from the mold and from the core remnants.

2. A process for making metal castings according to claim 1 wherein the mold core is shaped from material comprising dicalcium silicate as its principal ingredient, and a $\beta$ phase stabilizer for the dicalcium silicate, which stabilizer is a material selected from the group consisting of oxides of chromium, sodium oxide, molybdenum trioxide and boric oxide.

3. A process for making metal castings according to claim 2 wherein the mold core is destabilized prior to use in casting to promote the subsequent reversion of the dicalcium silicate to the ambient temperature phase, by heating the core in contact with a material selected from the group consisting of iron, ferric nitrate, iron oxide, nickel and nickel oxide, all in solid form, and ferrous solutions.

4. A process for making metal castings according to claim 1 wherein the mold core is destabilized prior to use in casting to promote the subsequent reversion of the dicalcium silicate to the ambient temperature phase, by heating the core in contact with a material selected from the group consisting of iron, ferric nitrate, iron oxide, nickel and nickel oxide, all in solid form, and ferrous solutions.

5. A process for making metal castings comprising pouring molten metal into a cored mold, the mold core being a sintered body consisting of dicalcium silicate as the principal ingredient wherein the dicalcium silicate is retained in a metastable phase thereof, controlling the cooling of the poured metal so as to cause self disintegration of the mold core during cooling upon reversion of the dicalcium silicate to its ambient temperature phase, and thereafter separating the metal casting from the mold and from the core remnants.

6. A process for making metal castings according to claim 5 wherein the mold core is destabilized prior to use in casting to promote the subsequent reversion of the dicalcium silicate to the ambient temperature phase, by heating the core in contact with a material selected from the group consisting of iron, ferric nitrate, iron oxide, nickel, and nickel oxide, all in solid form, and ferrous solutions.

7. A method of producing a casting core comprising dicalcium silicate as the principal ingredient, including the steps of sintering the dicalcium silicate core material in the temperature range in which the high temperature hexagonal phase is stable, and cooling said sintered core material at a rate such as to avoid the $\beta$ to $\gamma$ phase change.

8. A method of producing a core for a casting process, said method including the steps of:

(i) shaping said core from material comprising dicalcium silicate as at least the principal ingredient, (ii) sintering said shaped core in the temperature range in which the high temperature hexagonal phase of the dicalcium silicate is stable and (iii) cooling said sintered core at a rate such as to avoid the $\beta$ to $\gamma$ phase change.

9. A method of producing a core according to claim 8 and wherein said sintering temperature of said core is at least the pouring temperature of the metal to be cast.

10. A method of producing a core according to claim 9 and wherein cooling of said sintered core is effected by air quenching.

11. A method of producing a core according to claim 8 and wherein cooling of said sintered core is effected by air quenching.

12. A shaped casting core made by the method claimed in claim 8.

13. A method for producing a core for a casting process according to claim 8 wherein said material comprising dicalcium silicate as principal ingredient includes a $\beta$ phase stabilizer for the dicalcium silicate, which stabilizer is a material selected from the group consisting of oxides of chromium, sodium oxide, molybdenum trioxide and boric oxide.

14. A method for producing a core for a casting process according to claim 13, wherein cooling of said sintered core is effected by air quenching.

* * * * *